United States Patent [19]

Crocker

[11] 4,169,433

[45] Oct. 2, 1979

[54] ROTATIONAL MACHINE

[76] Inventor: Timothy R. Crocker, Ridge Gate, Steep, Petersfield, England

[21] Appl. No.: 797,262

[22] Filed: May 16, 1977

[30] Foreign Application Priority Data

May 19, 1976 [GB] United Kingdom ..... 20669/76
Sep. 17, 1976 [GB] United Kingdom ..... 38611/76

[51] Int. Cl.[2] ..... F02B 71/00

[52] U.S. Cl. ..... 123/46 R; 91/197; 417/328; 417/437

[58] Field of Search ..... 123/43 A, 46 R, 46 A; 91/502, 197; 417/328, 241, 437

[56] References Cited

U.S. PATENT DOCUMENTS

| | | | |
|---|---|---|---|
| 901,344 | 10/1908 | Horstmann | 417/328 |
| 1,511,985 | 10/1924 | Spencer | 123/46 R X |
| 2,876,704 | 3/1959 | Collion et al. | 91/502 X |
| 3,465,684 | 9/1969 | Moll | 417/328 |

FOREIGN PATENT DOCUMENTS

| | | | |
|---|---|---|---|
| 536323 | 2/1977 | U.S.S.R. | 417/328 |

*Primary Examiner*—Carlton R. Croyle
*Assistant Examiner*—Michael Koczo, Jr.
*Attorney, Agent, or Firm*—Karl W. Flocks

[57] ABSTRACT

A rotational machine developed mechanical power from the reciprocation of a free-piston in a closed cylinder to drive a mechanical output shaft or electrical generator or conversely operated in a pumping mode utilizes the rotation of an output drive to pump fluid by means of the free piston. The machine generally described has a frame means or outer body rotating about a first axis or shaft, a carrier means rotating about a second axis orthogonal to the first axis, the chamber or cylinder extending generally parallel to the second axis and orthogonal to the first axis. As the frame means rotates and the piston reciprocates, the reaction forces on the piston are translated into a torque producing rotation of the carrier means. Power is therefore developed at the carrier means in the engine mode of operation. Frame means rotation is effected by coupling to the carrier means or an independent prime mover.

12 Claims, 40 Drawing Figures

A
B
C
0°
30°
60°
90°
0-90°

A
B
C
120°
150°
180°
210°
120-210°

A
B
C
240°
270°
300°
330°
240-330°

A
B
C
x'(x)
y'
z'
z
y
z' INTO PAPER
y' OUT OF PAPER
x'(x) OUT OF PAPER
0-90°

A
B
C
z' INTO PAPER
y' OUT OF PAPER
x'(x) OUT OF PAPER
x'(x)
y'
z'
y
120-210°

A
B
C
z' INTO PAPER
y OUT OF PAPER
x'(x) OUT OF PAPER
240 - 330°

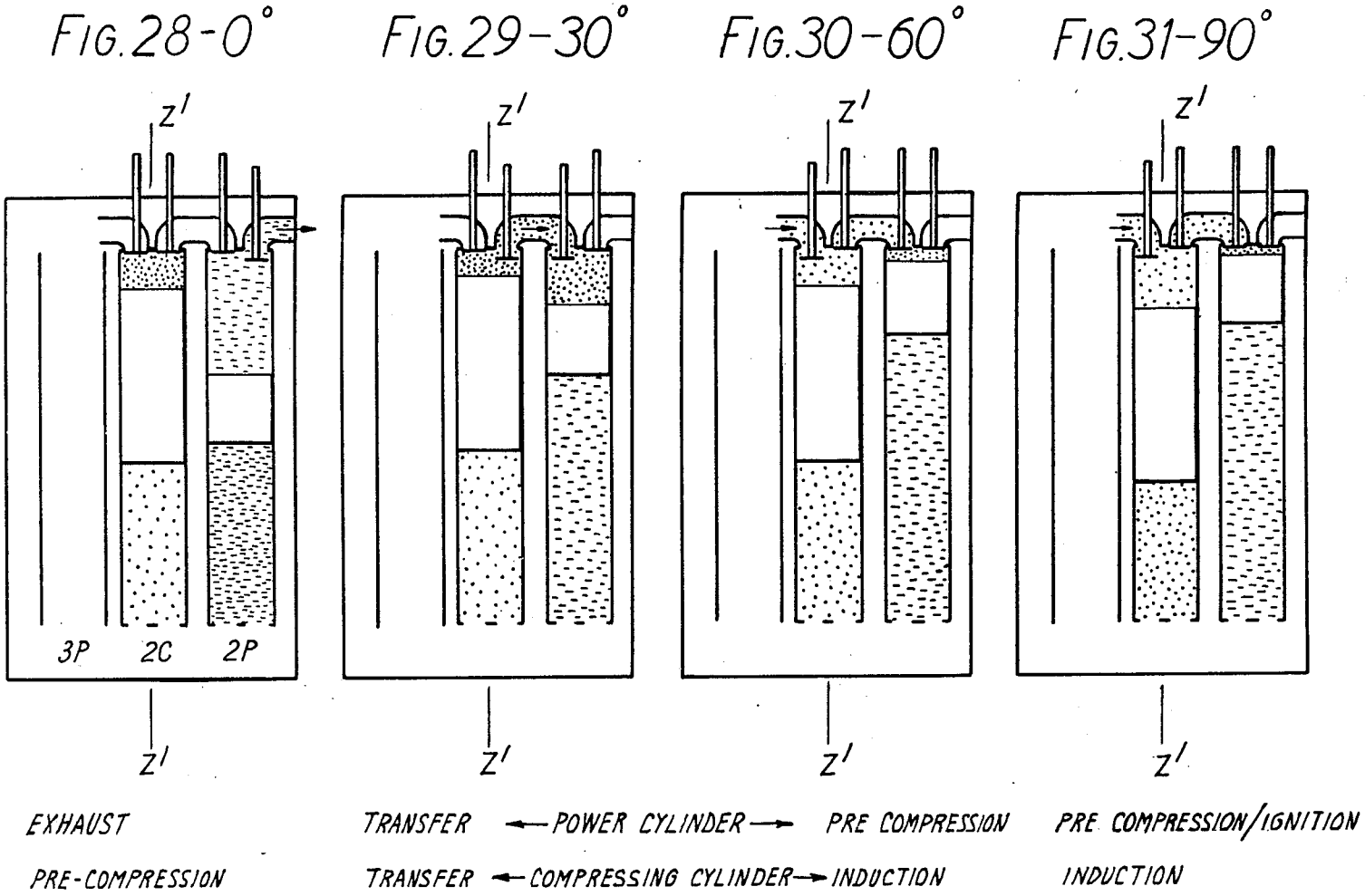
FIG. 28-0°
FIG. 29-30°
FIG. 30-60°
FIG. 31-90°
Z'
2P
2C
3P
EXHAUST
PRE-COMPRESSION
TRANSFER
TRANSFER
POWER CYLINDER
COMPRESSING CYLINDER
PRE COMPRESSION
INDUCTION
PRE COMPRESSION/IGNITION
INDUCTION

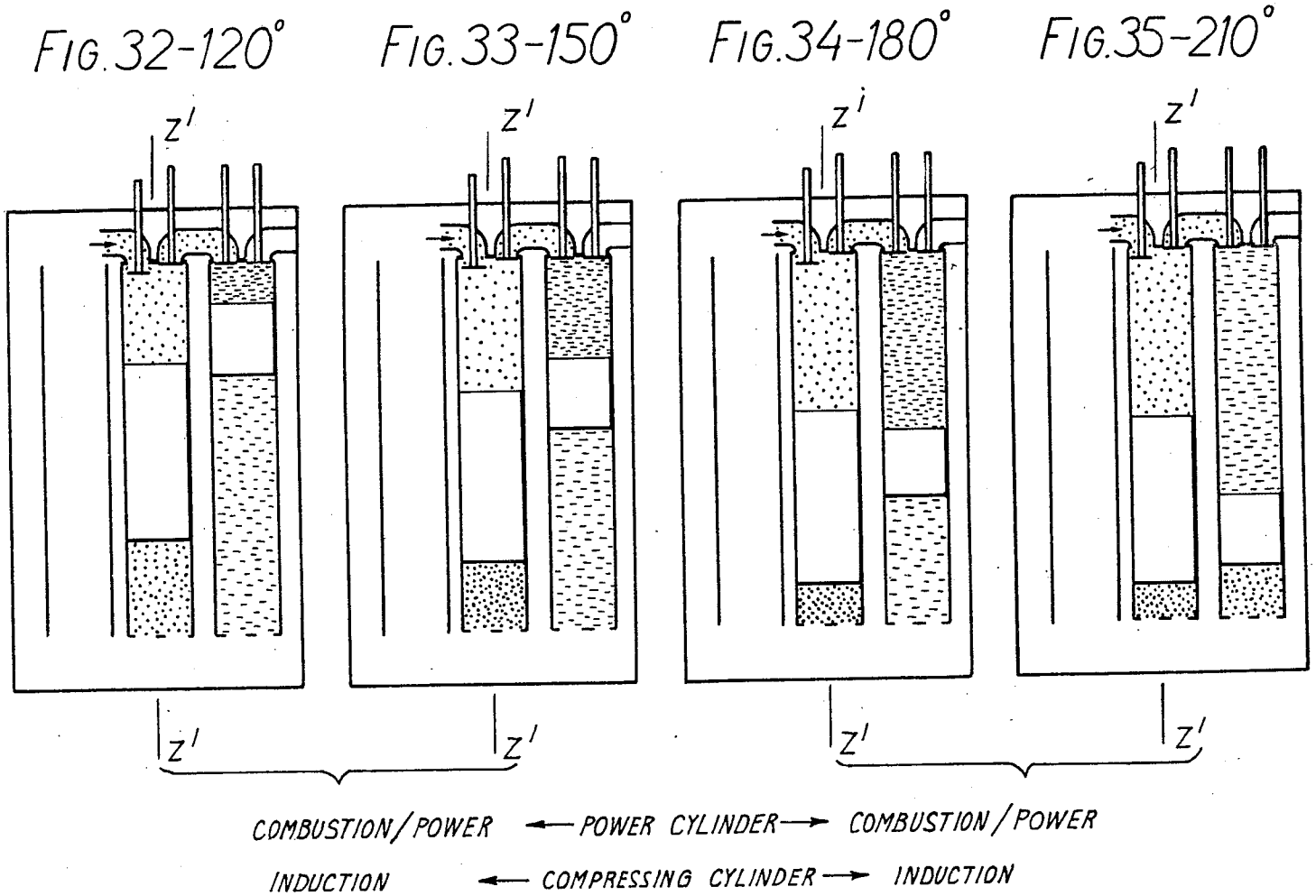
FIG. 32-120°
FIG. 33-150°
FIG. 34-180°
FIG. 35-210°
Z'
COMBUSTION/POWER
INDUCTION
POWER CYLINDER
COMPRESSING CYLINDER
COMBUSTION/POWER
INDUCTION

FIG.36-240°

Z'
EXHAUST
PRE-COMPRESSION
POWER CYLINDER
COMPRESSING CYLINDER
EXHAUST
PRE-COMPRESSION

ROTATIONAL MACHINE

BACKGROUND OF THE INVENTION

This invention relates to a rotational machine having at least one free piston.

On consideration of the most general rotational machine (engine, or compressor or pump) it is fairly clear that a cylindrical piston in a round bore will provide the simplest compression seal, comparison may be made with the difficult linear seals of the Wankel engine. It is also apparent that, since for machining reasons toroidal or other curved cylinder shapes are impractical, the piston must run in a straight cylinder, with the consequence that there must be reciprocation motion for work to be done. In engines, if this work is extracted by any of the conventional reciprocating means (such as crank and con-rod, swash plate, roller and eccentric), these reciprocating means provide the ultimate engineering limitation, with conflicting demands for lightness in order to reduce the dynamic losses, and strength to transmit the power developed.

It is an object of the present invention to provide a rotational machine in which a linearly reciprocating, heavy piston, which is entirely free in a double ended cylinder, can be coupled to a rotating shaft.

It is a further object of the present invention to apply the mechanical development underlying the transmission of power between a free-piston and a rotating shaft in illustrative embodiments of such rotational machines in the form of an engine driven by an externally supplied motive pressure medium, a rotational machine for use in pumping fluid mediums, and a rotational combustion engine developing its own motive medium by internal combustion.

In the aforegoing and throughout the claims defining the invention the term "shaft" has been used merely to designate the structural aspect of the frame from which torque may be delivered. Examples are a spindle as in one preferred embodiment or an annular flange.

SUMMARY OF THE INVENTION

According to one aspect of the present invention there is provided a rotational machine for use in developing motive power from a motive pressure medium comprising a shaft journalled for rotation, a frame rotatably coupled to the shaft for rotation therewith, a carrier rotatable in the frame about an axis transversely of the shaft, at least one chamber in the carrier, a piston arranged in the chamber to reciprocate in a direction transverse to the rotational axis of the frame, means acting for transmission of rotation between the carrier and the frame, and, means enabling the ported supply of motive pressure medium to reciprocate the piston, wherein the relative dispositions of rotational axes of the frame and carrier and the path of the piston are such that reaction forces to inertial forces acting on the piston are translated to rotational forces producing a torque on the shaft, whereby in use operation is in an engine mode in which by means of an externally supplied motive pressure medium the piston reciprocates and thereby drives the shaft.

The motive medium may be compressed air in which case the engine driven pneumatically as is described in relation to a preferred embodiment. Alternatively the motive medium may be steam.

In essence the rotational machines described herein may be described as rotational systems in which heavy pistons transmit power between a source or receiver of fluid under pressure, and a rotating shaft, the shaft being respectively a receiver or source of shaft work. The mechanism relies on the inertial forces on the pistons: they are otherwise free of mechanical connection within their cylinders.

In the simplest theoretical description of the engine mode one can say that the piston, having been set in motion by fluid pressure, tries to travel in a straight path in space, and reaction forces produced by constraining the piston motion to curve are arranged to turn a shaft. Since all parts of the system other than the piston are steady circular motion there are no non-contributory reciprocating masses.

Whilst the power is developed by rotation of the carrier means, the operation of the machine depends on the frame rotating to ensure the requisite piston motion. In a preferred embodiment the rotating means comprises coupling means for the transmission of rotation between the frame means to the carrier means.

According to a further aspect of the invention there is provided a rotational machine for use in pumping fluid medium comprising a frame arranged to be rotatable about its rotational axis, a carrier rotatable in the frame about an axis transversely of the shaft and adapted to be driven by an external agency, at least one chamber in the carrier, a piston arranged in the chamber to reciprocate in a direction transverse to the rotational axis of the frame, means for rotating the frame, and, porting means in said chamber, a port in the carrier communicating with said chamber, an axial inlet in the frame communicating via said porting means with said chamber, wherein the relative dispositions of rotational axes of the frame and carrier and the path of the piston are such that rotational forces producing a torque on the shaft are translated into inertial forces acting on the piston which through reaction forces cause a pumping action in the carrier by reciprocation of the piston to displace fluid medium between said axial inlet of the frame and said port in the carrier communicating with said piston, whereby in use operation is in a pumping mode in which rotation of the carrier by an external agency effects pumping means of reciprocation of the piston. It is also necessary to the operation of this machine that the frame means rotates to provide the requisite piston motion, whilst the pump power is developed by the rotation of the carrier means. In one embodiment an auxiliary prime mover means is arranged to rotate the carrier means about its own axis and separate means is provided for rotation of the frame means. Such a prime mover means is provided by an electric motor.

In the described embodiment the means for rotating the frame comprise transmission means for the transmission of rotation from the carrier to the frame. The machine may comprise shaft means with which said frame is rotatable, said shaft means being adapted to be driven by an external agency thereby to drive said carrier via said transmission means.

According to another aspect of the invention there is provided a rotatable combustion engine comprising a rotatable frame means, a carrier means rotatably carried in the frame means, a plurality of chambers in the carrier means, the carrier means and the frame means having their respective axes of rotation arranged mutually transverse one to the other, means for transmission of rotation between the carrier means and a driven part a piston within each chamber reciprocable transversely to the axis of rotation of the frame means, means for the admission of fuel into the chambers, means for ignition of the fuel for combustion thereof to effect reciprocation of the pistons, and means for exhausting the spent fuel products, wherein pre-compression of the fuel is effected by the pistons and the sequencing of the piston reciprocations determines that piston motion is translated into rotation of the carrier means for development of motive power for supply to an external mechanism.

In the preferred embodiments the means for admission of fuel may be either for fuel induction or for fuel injection.

In one embodiment said driven part is the frame means and said transmission means comprises coupling means between said carrier means and said frame means.

In another embodiment said driven part is mechanically connected to be driven by said carrier means and is adapted to drive an external mechanism, means being provided for independently rotating the frame means.

In a further embodiment said driven part is an electrical generator mounted within said frame means, and by means of which the motive power developed by said carrier means may be converted into electrical power, means being provided to enable said electrical power to be conducted externally of the frame means.

In yet another embodiment said driven part is housed within said frame means and comprises the driven member of a frame of a rotational machine for use in pumping fluid medium and means is provided for independently rotating the frame means.

The motive medium is ported to the chambers as the carrier rotates such that the reciprocation of the pistons may be sequenced. Obviously, when the motive medium is a combustible medium, it is also necesssary to make provision in the chambers for ignition in the sequence required.

BRIEF DESCRIPTION OF DRAWINGS

Embodiments will now be described, by way of example only with reference to the accompanying drawings, in which:

FIGS. 28 to 39 show schematically a cycle of the cylinders of FIG. 27 in the operation of this rotational machine; and, FIG. 40 is a modification of FIG. 1 illustrating independent transmission to and from the carrier and frame.

DETAILED DESCRIPTION OF EMBODIMENTS

Figure 1:
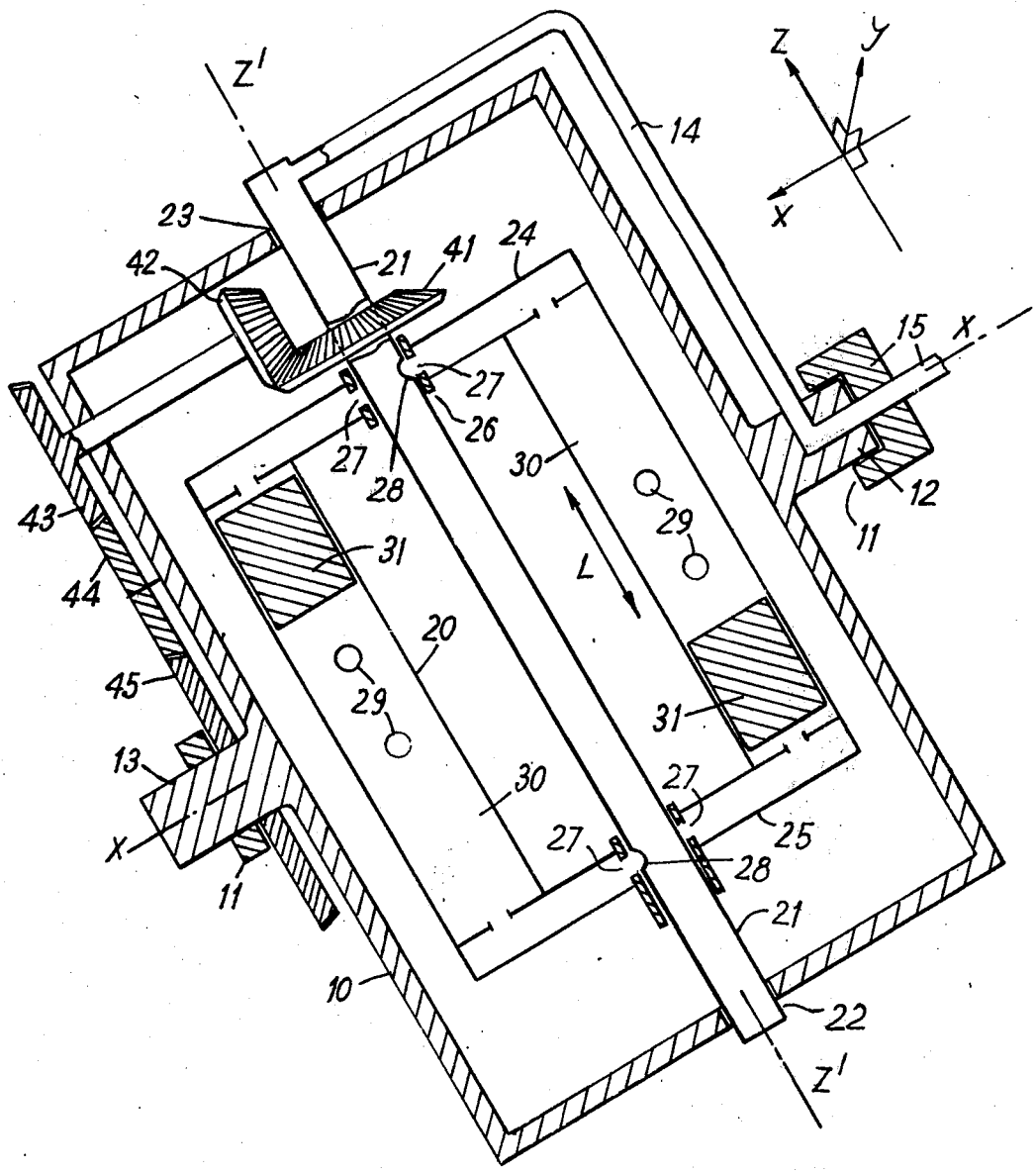
FIG. 1 is a schematic view of a pneumatically powered rotational machine which may also be operated in its pumping mode to pump a fluid medium.

In FIG. 1 a rotational machine is shown diagrammatically. There are three degrees of movement.

Firstly, frame 10 is rotatable about axis X (=X') which is defined by stationary bearings 11 in a support (not illustrated) for spindles 12,13. In the engine mode, air input is achieved via housing 15, passage 14 and spindle 12, and torque output is obtained via spindle or shaft 13.

Secondly, a carrier 20 is rotatable about axis Z' which is defined by shaft 21 located in bearings 22,23 in frame 10. Carrier 20 comprises housings 24,25 each defining end supports between which extend chambers 30 and each defining radial passages (not shown) leading from apertures 27 in central bearings 26. Central bearings 26 enclose shaft 21 having an aperture 28 at either end which register with the apertures 27 of bearings 26 to function as inlet ports at a given rotational alignment. Aligned radially with the inlet ports are the radial passages (not shown) leading to the chambers 30. Thus, compressed air may be ported alternately to opposite end of chambers 30 (as will be described) and to the chambers 30 in sequence.

Thirdly, within each chamber 30 is a freely displaceable piston 31 capable of linear reciprocation longitudinally of the chamber in direction L. As shown direction L is parallel to axis Z' and orthogonal to axis X. Chambers 30 meet perpendicularly the housings 24,25 and are of right-cylindrical form. The axes X,Y,Z are the fixed geometric co-ordinates, and X', Y', Z' the geometric co-ordinates of the moving machine. As above stated X=X'.

Air input is achieved through spindle 12, via pipe 14 to shaft 21 and then via the radial inlet ports (28,27) in shaft 21 and bearings 26 into the radial passages in housings 24,25 and thence to chambers 30.

Each chamber 30 is partitioned by its piston 31 into a pair of cylinders of variable volume, instantaneously these cylinders have complementary functions as will become further apparent. In this embodiment, the carrier 20 has three equiangularly spaced chambers 30.

The linear reciprocation of the pistons 31 in chamber 30 is translated into rotation of the carrier 20 about the axis Z'. This rotation is transmitted through the gearing 41 to 45 to the frame 10 for rotation about the X-axis, and at spindle 13 developes an output torque. The gearing 41 to 45 results in a one to one transmission ratio such that the frame 10 completes a revolution for each revolution of the carrier 20.

Primarily the machine is designed to ensure that the reaction forces to the inertial forces acting on the pistons 30 are translated to rotational forces acting on the frame 10 and producing an output torque on the spindle 13. In this context, the motion of carrier 20 is significant to the transmission of reaction forces to inertial forces. The gearing 41 to 45 permits transmission of directly, mechanically coupled motion between the carrier 2 and frame 1, and vice versa.

In FIG. 1 the apertures 28 in the shaft 21 register with the apertures 27 in the bearing 26 as stated above. The apertures 27 in the bearings 26 are arranged rotationally symmetrically (with their centres spaced at 120° intervals) to communicate with the abovementioned radial passages and thus respective ones of the three chambers 31. The apertures 27 are dimensioned such that they register with the aperture 28 at the respective end of shaft 21 for substantially 180° of rotation as illustrated in the series of FIGS. 14 to 25. The longitudinally spaced pair of apertures 28 are spaced rotationally by 180° such that the register of aperture 28 and apertures 27 at the left hand of shaft 21 is 180° out of phase with the corresponding register at the right hand of shaft 21. Thus, for a given chamber 30 air is admitted at opposite ends at rotational intervals of 180°. The phasing of the admissions relative to the longitudinal positions of the pistons 31 is determined by the indexing of the rotational positions of aperture 28 and apertures 27 at a notional starting point—defined in relation to the later drawings as the (0°) position. In practice, shaft 21 may be rotationally displaced relative to the frame 10, whilst the machine is inoperative, in order to adjust the phase angle to obtain optimum results.

With this pneumatically driven model of the machine, it is necessary to exhaust the air. This is achieved via exhaust outlets 29 located midway along chambers 30 and spaced so as to be just capable in their plurality of being covered by the piston 31. The piston 31 partitioning the chamber 30 into a pair of cylinders thus vents one cylinder as the air in the other cylinder commences compression under the motion of the piston 30.

In an actual model, the mass and length of pistons 31 was 100 grams and 1.10 inches, the chambers 30 had internal dimensions of 4.95 inches in length and 0.90 inches in diameter. For a rotational speed of 600 revolutions per minute of the spindle 13, it was necessary to apply a pneumatic pressure in the order of 8 p.s.i. for idling and 20 p.s.i. when taking maximum output torque from spindle 13.

OPERATION

Reference is now made to FIGS. 2 to 13 for describing the pneumatically driven model so far as concerns a cycle of operations.

Each of these FIGS. 2 to 13 is divided into three parts A, B and C. Part A shows the degree of rotation of the carrier about the Z'-axis starting from a notional initial position (0°): the three pistons being numbered sequentially in the clockwise sense 1, 2 and 3. Part B is a plan view of the carrier 20 in the plane of the X,Z' axes schematically depicting each chamber 30 and the respective linear movement of the pistons therein corresponding to the respective degree of rotation of the carrier 20 about the Z'-axis as shown in Part A. Part C shows the corresponding plan view of the carrier in the Z,Y plane illustrating the degree of rotation of the frame member 10 about the X-axis. In this series of drawings, FIGS. 2 to 13 are illustrations taken at positions, shown in Part A, advancing each time by 30° of rotation of the carrier 20 about the Z' axis.

Each of FIGS. 14 to 25 represent a stage in the sequence of operations similar to those shown in FIGS. 2 to 13.

The two series of drawings FIGS. 2 to 13 and FIGS. 14 to 25 show the two extreme types of cycle. FIGS. 14 to 25 showing the cycle producing the maximum power (and torque) for the given revs. FIGS. 2 to 13 showing the cycle when the machine is running freely, with no constraint at all on the piston in the cylinder i.e., no input of compressed air, and ignoring actual ambient air pressure and the effect of gravitational forces. In operation the machine produces power with any "phase angle" between these. The term "phase angle" relates to the phase of the register of apertures 27 and 28 as described in relation to FIG. 1. The "porting angle" P and "phase angle" $\phi$ are mathematically related below, the porting angle being the angle at which the maximum pressure and maximum register of the ports is required to maintain the cyclic motion.

The actual principle of operation may be understood from the 'Full power cycle' illustrated in FIGS. 14 to 25. The pistons 31 have been drawn in the position where full power is produced. This assumes a sinusoidal motion of the pistons 31 in the chambers 30 and this sinusoidal motion is quite symmetrical about the midpoint of the chambers 30. The force on the pistons 31 which accomplishes this sinusoidal motion is diagrammatically represented in the Parts B and C of FIGS. 14 to 25 by the arrows and cross hatching. The magnitude of the force is represented by the length of the arrow (Part B) and also represented by the density of the cross hatching (Part C). Cylinder numbers in circles are those of cylinders that are hidden. In Part A, the entry of compressed air at one end is illustrated dotted whilst the entry at the other end is illustrated in cross-hatch i.e., inlet flow at the two ends is illustrated in a single Figure by superposition.

It can be seen that the force on the pistons 31 has assymmetric values in each half cycle. In an analogy with an ordinary crank engine, the greater force is required in the later, down stroke part of each cycle. In the part A series of FIGS. 14 to 25 it is attempted to show the "porting angle" enabling the pneumatic model (of FIG. 1) to operate at full power and develop maximum torque at spindle 13.

Tracing the motion of the piston 31 in the Part C series of FIGS. 14 to 25, indicates that, in this full power cycle, each piston 31 completes a circular path (in the plane of Part C of the drawing twice during each revolution of spindle 13 about axis X. During this cycle, the piston 31 moves in and out of the plane of Part C such that the actual motion is that of an ellipse in space.

In the cycle depicted in FIGS. 2 to 13 of the drawings, the spatial paths of the pistons 31 have reduced to straight lines in space parallel to the spindle 13. In this idling cycle, the centre of gravity of each piston 31 appears to remain stationary in the views of part C of FIGS. 2 to 13. This is because the pistons 31 slide up and down the chambers 30 in order to maintain the same spatial location. Movement in and out of the plane of part C of the Figures occurs with movement of chambers 30. The total stroke of pistons 31 is now only the "radius R" of the machine (see below).

As expressed above in the drawings illustrating the cycles, the coordinate system used namely X,Y,Z are fixed in the space. X', Y', Z' correspond for 0° of rotation, but revolve with the frame 10, and are a co-ordinate system that relate to the frame. X' is the direction of the spindle 13, Y' is the normal to the plane defined by the spindle 13 and shaft 21, and Z' is the direction of the shaft 21. Y and Z correspond to Y' and Z' for 0° of rotation i.e., in FIGS. 2 and 14. Of course X always equals X'. Rotation is restricted to the Y,Z plane. The "radius" of the machine is R. R is the distance from the centre of each chamber 30 to the centre of the machine. The displacement in the Z' direction of the piston 31 under consideration is d. The angular velocity of spindle 13 is w and, therefore the angle rotated by spindle 13 is wt where t is the time.

Figures 2, 3, 4, 5:
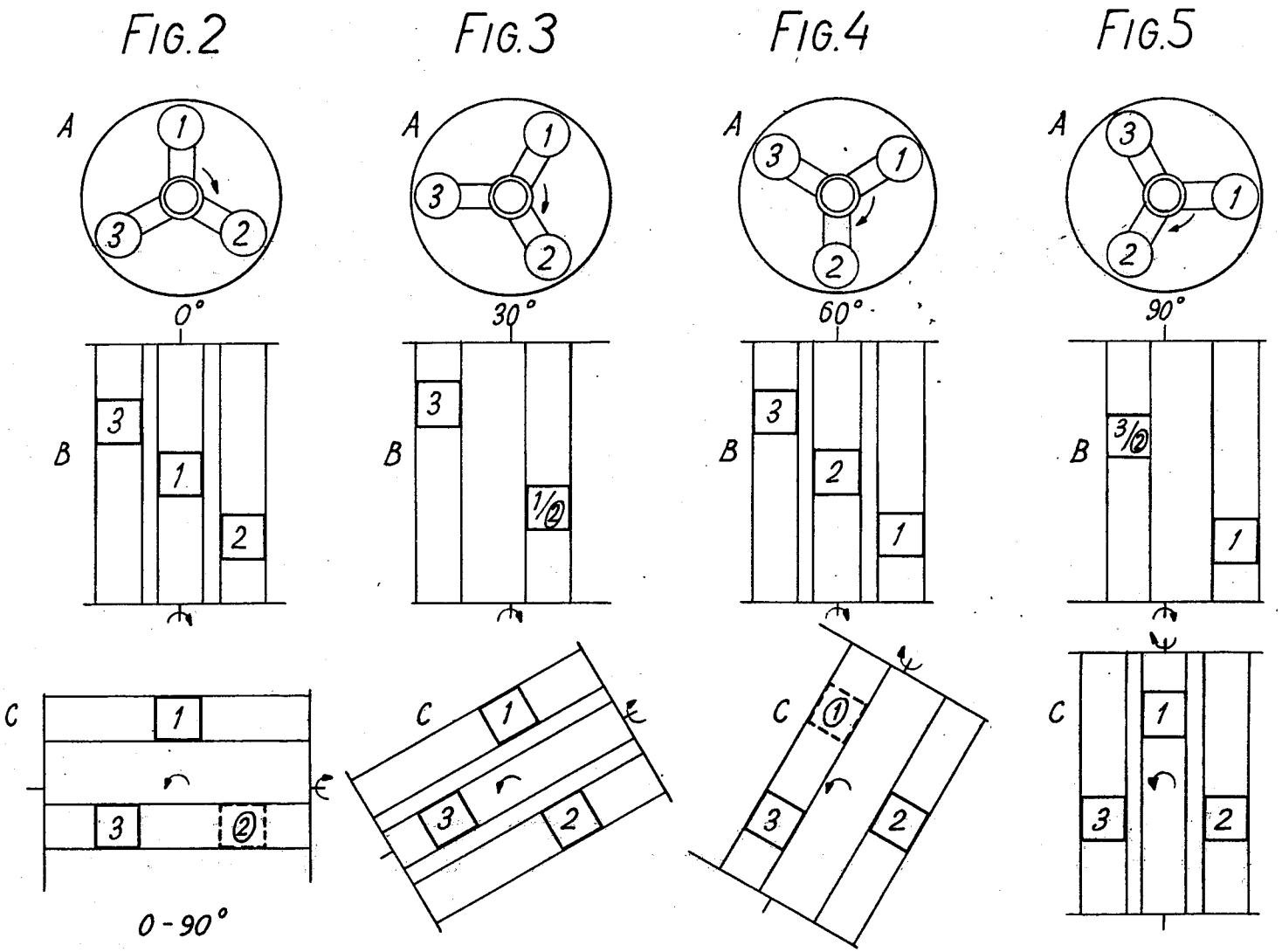
FIGS. 2 to 13 depict a first series of theoretical positions for parts of this machine when the machine is idling (ideal conditions); and, FIGS. 14 to 25 depict a second series of theoretical positions for parts of this machine when the machine is developing maximum torque (under ideal conditions)
Figures 6, 7, 8, 9:
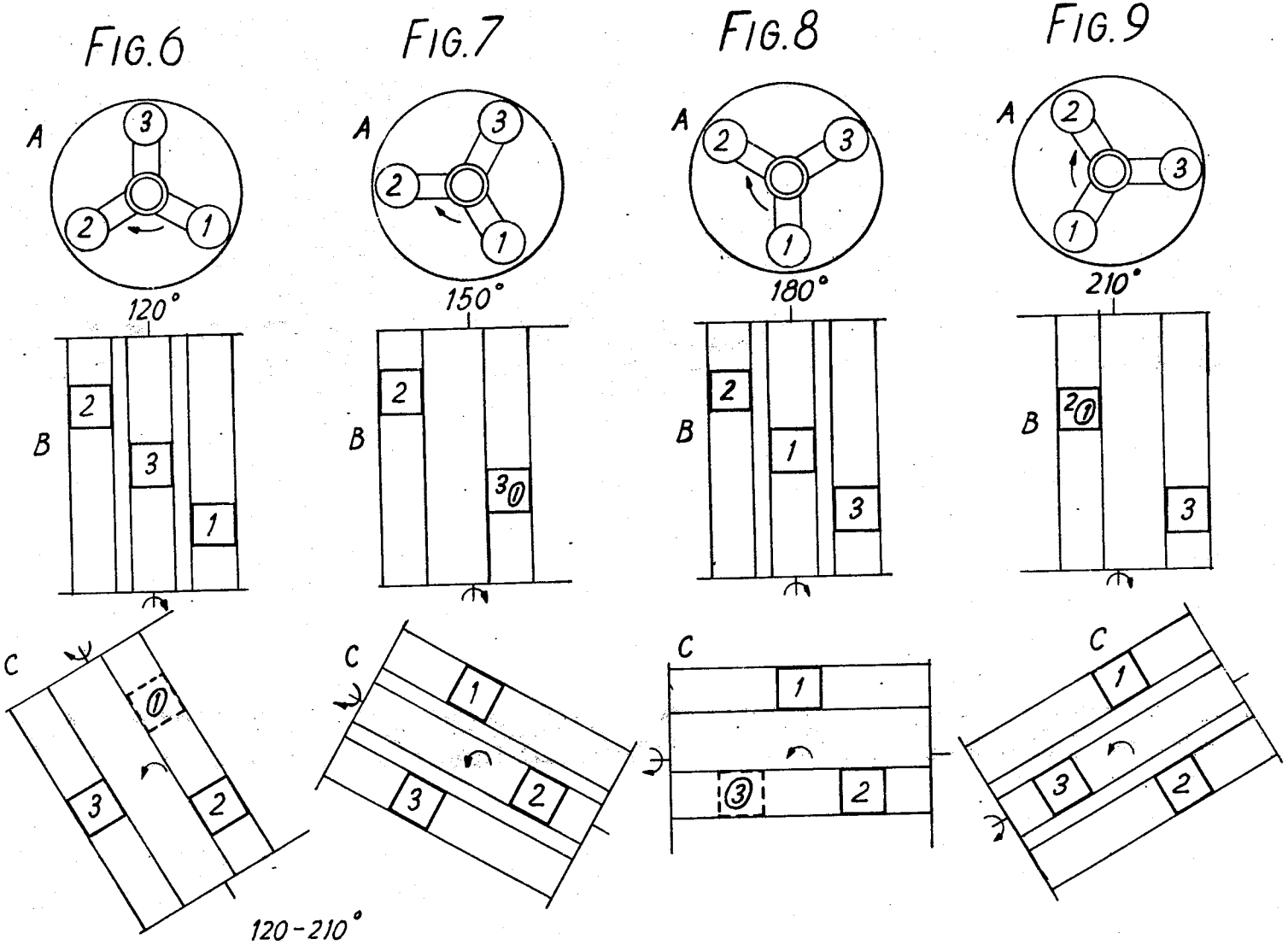
Figures 10, 11, 12, 13:
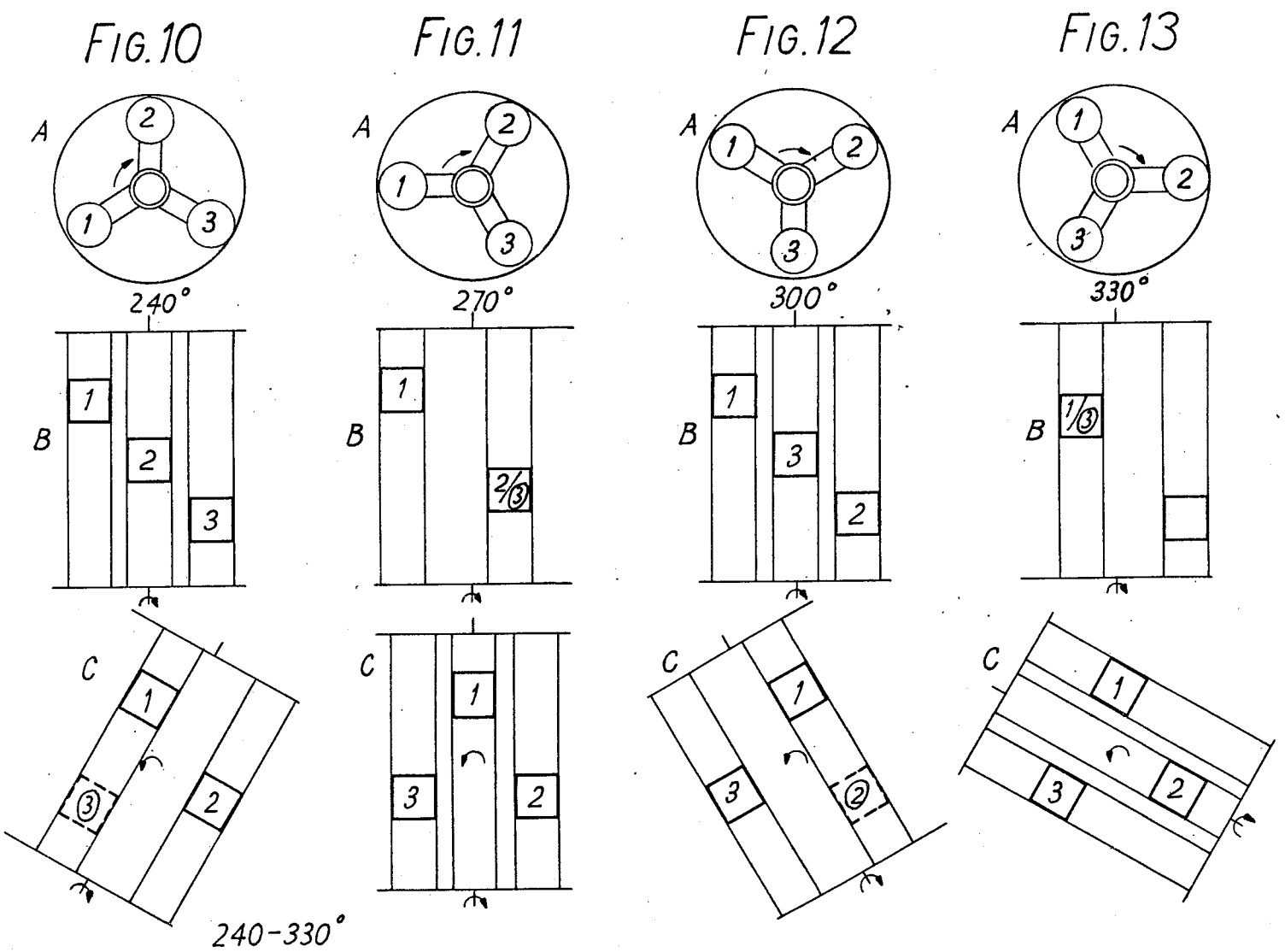
Figures 14, 15, 16, 17:
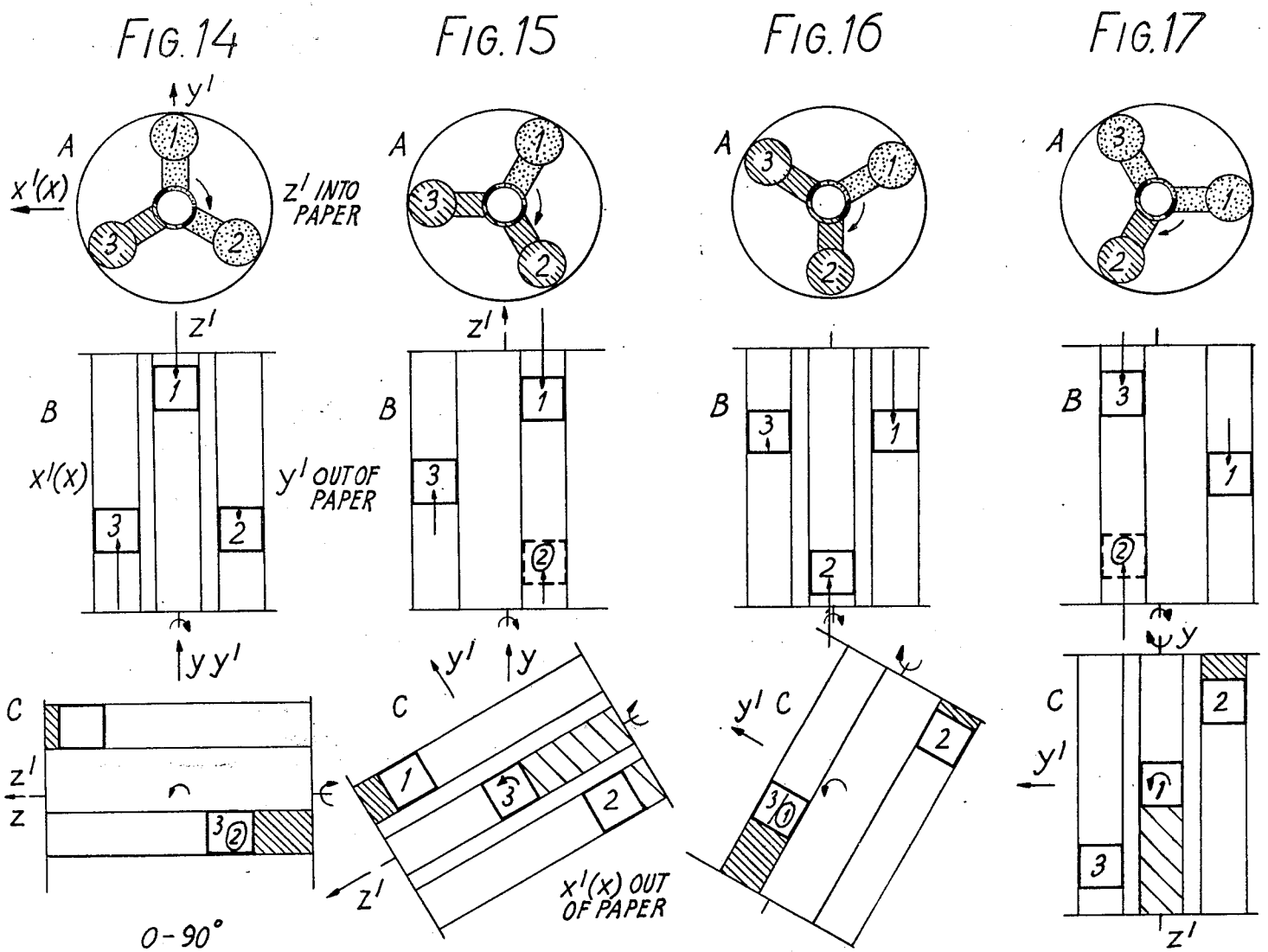
Figures 18, 19, 20, 21:
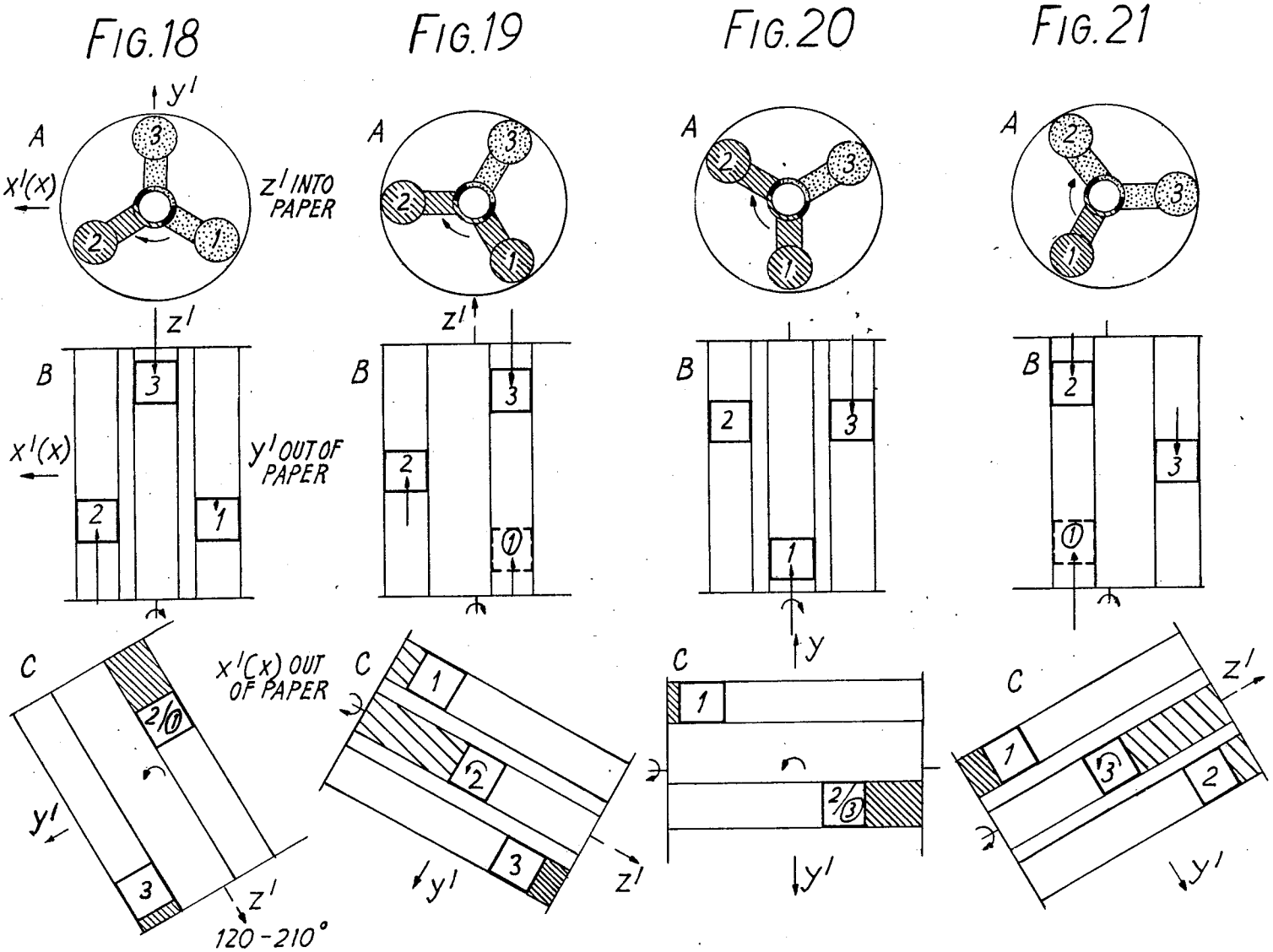
Figures 22, 23, 24, 25:
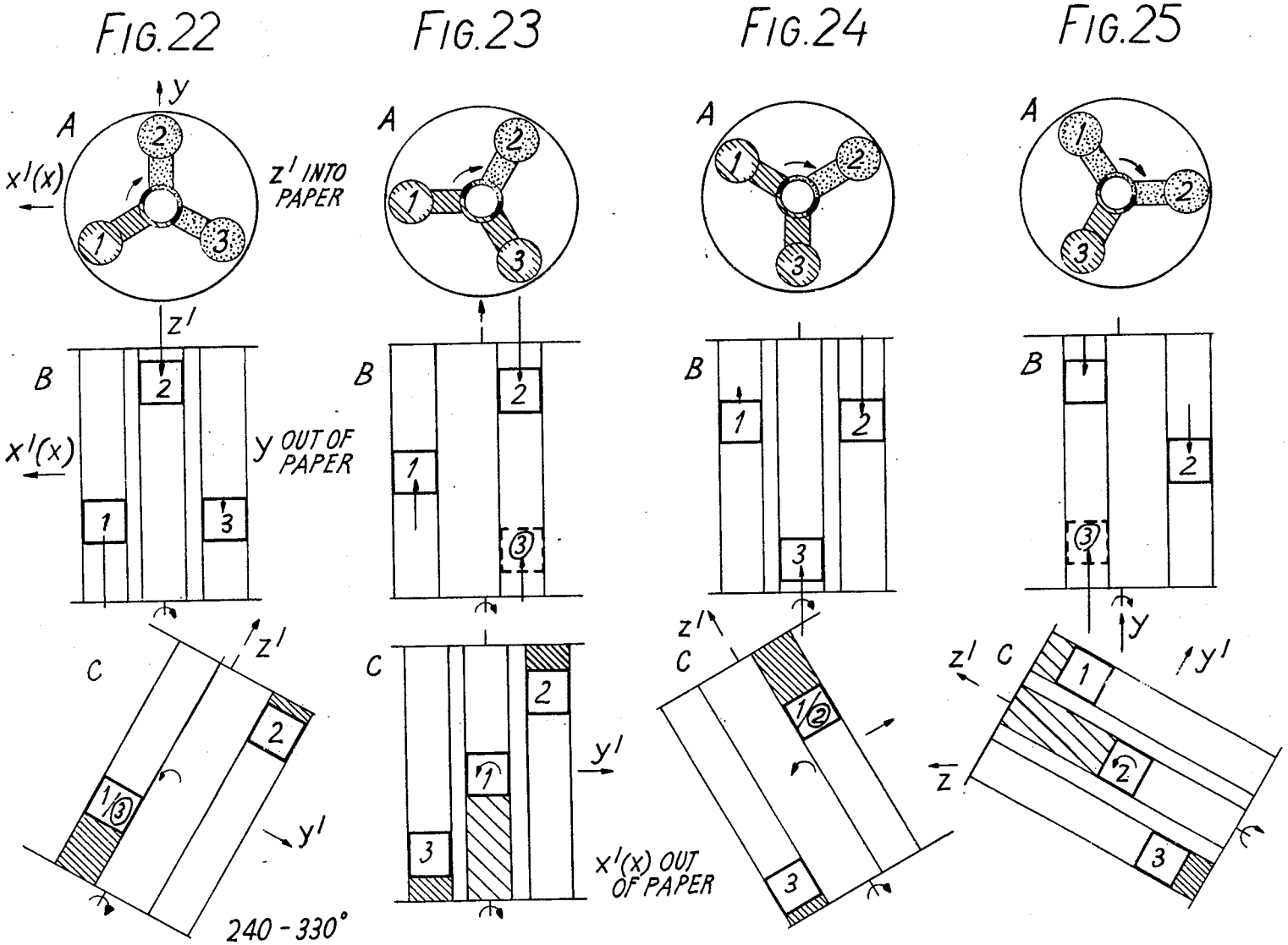

For the purpose of mathematical description the angles wt, $\phi$, P are measured for the cylinder under consideration from the position where that cylinder is in the Y', Z' plane on the positive X side. In relation to the angles shown in FIGS. 2–13, 0° mathematically corresponds to 270° shown for cylinder 1 (FIGS. 11 and 23), 150° shown for cylinder 2 (FIGS. 7 and 19), 30° shown for cylinder 3 (FIGS. 3 and 15).

On the assumption that the motion of the pistons 31 is described by the expression:

$$d = k\,R \sin(wt + \phi) \qquad (1)$$

where $\phi$ is the "phase angle" and k is a scaling factor determining the length of stroke in the chamber 30 in relation to R, then, the power out, (averaged over cycle) is given by the expression:

$$mkw^3 R^2 \cos \phi \quad (2)$$

where m is the mass of the piston 31 or pistons 31.

The force on the piston 31 in the axial direction of the chamber 30 in order to obtain sinusoidal motion and symmetrical displacement is given by the expression:

$$2mRw^2 (\cos wt - k \sin (wt+\phi)) \quad (3)$$

The "porting angle" P which is the angle at which the maximum force [as defined in (3) above] is exerted on the piston is given by $$P = \tan^{-1}\left(\frac{k \cos \phi}{k \sin \phi - 1}\right) \quad (4)$$

From these expressions (1) to (4) the force indications of Parts B and C of FIGS. 14 to 25 were calculated and drawn, for a machine having the parameters given above.

In expression (3) the factors k and $\phi$ are not independent for a given piston force.

A model of the pneumatically driven machine has been operated and useful results achieved with $\phi \sim 70°$ and $k \sim 1$. The cycle depicted in FIGS. 2 to 13, the free running condition, corresponds to values of expression (3) when $\phi = 90°$ and $k = 1$.

MODIFICATIONS

Modifications of the machine of FIG. 1 are envisaged. As an alternative to compressed air as the motive medium, the machine may operate on a steam or hot gas input. Any number of chambers 30 from one upwards may be used. The chambers 30 need not run parallel to the shaft 21, viz the Z' axis. The machine may be modified by arranging the longitudinal direction of the chamber 30 to be inclined to the Z' axis in the X', Z' plane, even as seen in that plane intersecting the Z' axis. The essential condition is that the longitudinal direction of the chamber is not perpendicular to the Z'-axis.

The balance of the machine is clearly better for a plurality of chambers 30 (two or more) when these are rotationally symmetrically distributed. Odd number of chambers 30 are advantageous for complexity in terms of power delivery, and an even number are advantageous for internal balance of the machine. The gearing of FIG. 1 through gears 41 to 45 gives a gear ratio of one to one. This simple ratio gives satisfactory results. It appears that a ratio of one to nearly one is preferable when consideration is given to even wear of the machine. Multiple gears 41 to 45 are not essential. In fact a pair of bevel wheels (not shown) appears more practicable. Other ratios may be used equally well, the output torque is proportional to the product of inner and outer rotational speeds.

The machine has been described in the "engine mode". Reversing the machine such that torque is applied to spindle 13, it may be operated in the "pumping mode" as a pump, in expression (3) above $k < 1$. The piston motion is still sinusoidal. The apertures 27, 28 may be the same, but their design, then, may involve consideration of the materials being pumped. The nature of the pumped materials will also determine the surface properties of the chambers 30 and pistons 31.

In the context of inertial transmission, it is envisaged that an embodiment may be constructed in which there is no mechanical coupling via gearing 41 to 45, but in which a torque is applied to rotate the carrier 20 or frame 10 independently for example, by means of an electric motor.

The actual shape of frame 10 and carrier 20 will be determined according to various engineering design parameters, for example, the need to exhaust used motive medium. The carrier 20 may be cylindrical, the frame 10 may have a three dimensional, e.g. spherical form.

INTERNAL COMBUSTION ROTATIONAL MACHINE

Structure

Figure 26:
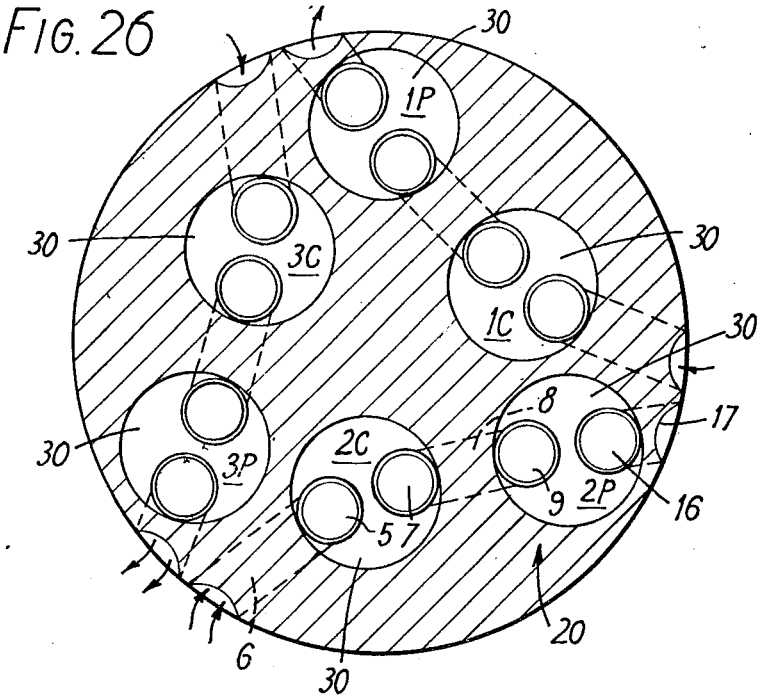
FIG. 26 shows schematically an end view of the carrier of an internal combustion rotational machine similar to that of FIG. 1.
Figure 27:
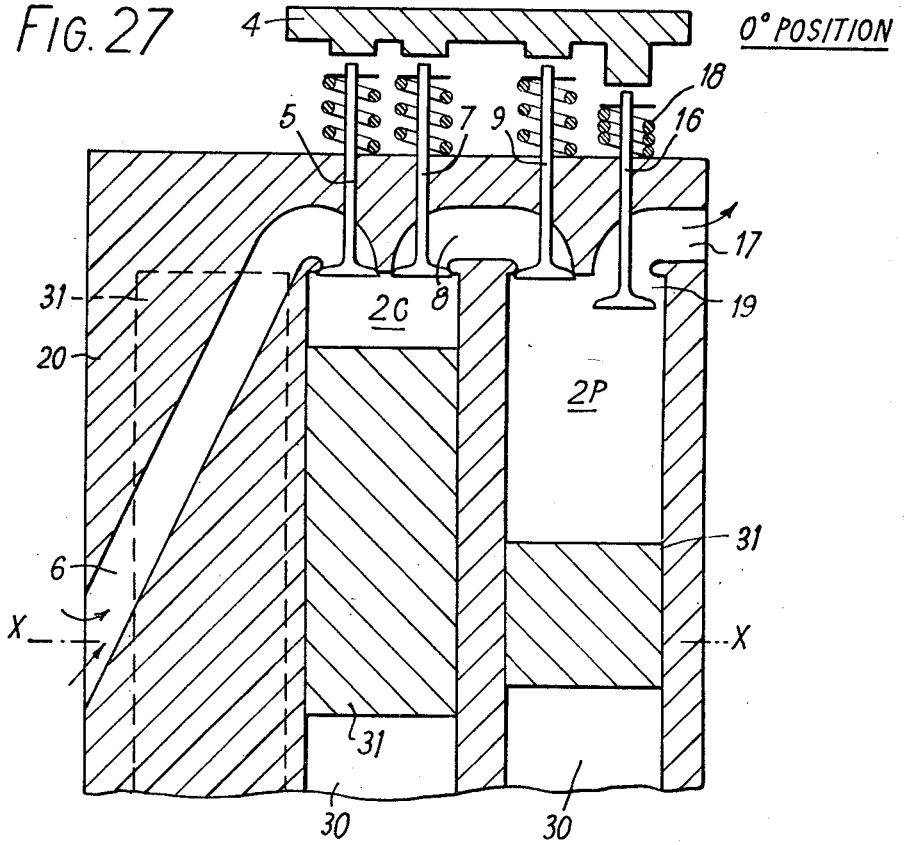
FIG. 27 shows schematically in longitudinal section a pair of chambers in the carrier of FIG. 26.
Figures 37, 38, 39, 270, 300, 330:
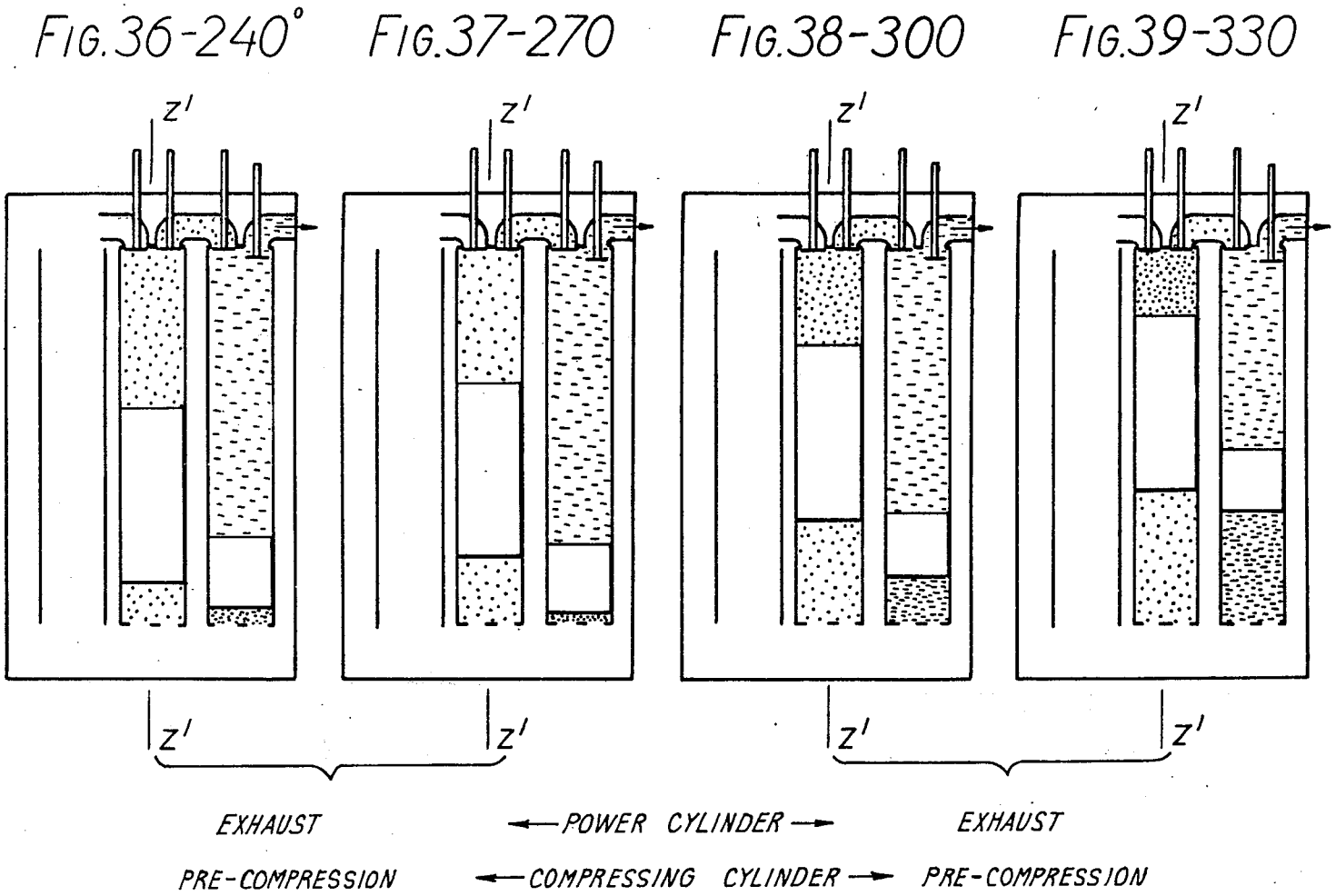

The internal combustion rotational machine of FIGS. 26 and 27 has a generally similar structure in the overall perspective of the machine as the embodiment described in relation to FIG. 1. FIG. 26 shows an end view of a carrier 20, such as the carrier 20 of FIG. 1, except that this carrier has three pairs of chambers 30 arranged in pairs designated 1*p* and 1*c*, 2*p* and 2*c*, 3*p* and 3*c*, the suffix p designating power cylinders receiving compressed fuel gas from cylinders with the suffix c signifying compression cylinders. In each cylinder there is a corresponding piston 31, the cycle of which will be described below in relation to FIGS. 27 to 39 which correspond to FIGS. 14 to 25 in the operation of the embodiment of FIG. 1 as a pneumatically powered rotational engine.

In the view of FIG. 27 there is seen a longitudinal section on the pair of cylinders 2*c* and 2*p* of FIG. 26. Each cylinder has an inlet valve and an outlet valve controlled by cam plate 4 which is stationary with respect to the rotating carrier 20. In FIG. 27 the cylinder 2*c* which is the compression cylinder for the pair 2*c* and 2*p* has an inlet valve 5 controlling an inlet 6 for the admission of fuel to the cylinder 2*c*. An outlet valve 7 controls the discharge of compressed fuel mixture from the cylinder 2*c* to the outlet 8 communicating as an inlet to the cylinder 2*p* under the control of inlet valve 9. Cylinder 2*p* has an outlet valve 16 to allow the discharge of exhaust gases through the exhaust port 17. Each of the valves 5, 7, 9 and 16 are as shown resiliently biased by resilient means 18 to close their respective valve seats 19 illustrated in respect of the valve 16 which is shown in its open position. As also illustrated in FIG. 27, chambers 30 do not have exhaust apertures 29 as indicated in the embodiment of FIG. 1 for the pneumatic model. It will be readily appreciated that since the passages 8 and 17 are provided that apertures 29 are not pertinent to this embodiment. As illustrated the piston 31 in chamber 2*c* is dimensioned to give the appropriate compression and induction stroke whereas the piston 31 in power cylinder 2*p* is dimensioned for the appropriate power stroke.

OPERATION

The embodiment of internal combustion rotational machine illustrated in FIGS. 26 and 27 as a modification of the embodiment of FIG. 1 constitutes a machine which by analogy with conventional engines may be described as a four stroke internal combustion engine.

Much of the technology of conventional internal combustion engines with regard to fuel admission, the sequencing of valve operations and the porting of fuel and gases will not be further described herein.

The operation of the present machine will now be described and reference may be made to FIGS. 28 to 39 illustrating a cycle in the operation of the compression and power cylinders *2c* and *2p*. Similar remarks are applicable in respect of the other pairs of cylinders *1p* and *c* and *3p* and *c*. As will be appreciated the phasing of the three pairs of cylinders will be arranged for optimum power development. The ignition means have not been shown and this is considered to be an aspect of the engine which does not require explanation. The structure and operation of such ignition means would be derived from conventional technology.

Each of the inlet passages 6 and outlet ports 17 communicate with supply ducts within the frame means 10 by means of rotating seals (not shown). Input gas is drawn through the rotating seal of the inlet passage 6 under the control of the valve 5. This input gas may be a fuel mixture or the fuel may be injected directly into the chamber *2c* formed by the compression piston 31 and the chamber 30 of that cylinder. This induction phase of the operation is illustrated in FIGS. 30 to 35. The piston 31 in cylinder *2c* then returns to the top of the chamber 30 in the compression phase of the operation. Near the top of the stroke of the piston 31, valves 7 and 9 open for the transfer of the compressed fuel mixture to the power cylinder *2p* via the transfer passage 8; pre-compression and transfer is illustrated in FIGS. 36 to 39 and 28 and 29 in respect of the cylinder *2c*.

The power cylinder *2p* as indicated in FIG. 29 on receiving the fuel mixture from the compression cylinder *2c* begins its own pre-compression phase following which ignition occurs at the position indicated in FIG. 31. On ignition we pass through the combustion cycle with corresponding power development illustrated in respect of the power cylinder *2c* in FIGS. 32 to 35. In the next phase of operation with respect to power cylinder *2p* we have the exhaust phase of FIGS. 36 through FIG. 39 and FIG. 28 leading once again to the admission of fuel by transfer from the compression cylinder *2c* commencing in FIG. 29. It will be appreciated that exhaust valve 16 opens at the bottom of the power stroke as illustrated in FIG. 36. Near the top of the exhaust stroke, the valves 7 and 9 open to allow the transfer of the pre-compressed fuel mixture from the compression cylinder *2c*. This is the point at which the valve 16 closes. By analogy with the conventional two stroke cycle this operation which is critical is termed the "scavinge operation".

As indicated above the valves 5, 7, 9, and 16 are opened by the operation of cam plate 4. The cam 4 does not form part of the present invention and conventional technology may be employed for this feature. Likewise the valves are returned by the resilient means 18 in conventional manner.

In FIGS. 28 to 39 the areas illustrated as dotted represent unburnt gas (either air fuel mixture of air alone). The flecking shows burnt or burning gas. The relative densities of these markings is intended to indicate the pressure at the various stages of operation. The aforegoing description has been in relation to the cylinders formed at the upper ends of the chambers 30 by the pistons 31. As in the embodiment of FIG. 1 each chamber is divided by the piston into a pair of variable volume cylinders, The operational sequence for the cylinders at the lower ends of the chambers 30 will be 180° out of phase with that described above.

In the context of the operation of the embodiment of FIG. 1 a mathematical description was given in which the expression phase angle $\phi$, the scaling factor k and the radius of operation R were defined. In a theoretical analysis of the present model the compression cylinder *2c* operated with a phase angle $\phi$ of 260° and the power cylinder *2p* operated with a $\phi$ of 280°. Each cylinder was designed with a scaling factor k of 1.5. According to this theoretical treatment the swept stroke of the cylinders may be controlled by treating the phase angle $\phi$ and the scaling factor k as variables either of which may be adjusted to adjust the swept stroke. As is illustrated by virtue of the geometry of the cylinder pairs in relation to the Z axis of rotation of the carrier 20, the power cylinders *1p*, *2p* and *3p* are indicated to be at equi angular locations i.e., spaced mutually by 120° and the compression cylinders are likewise equi angularly spaced by 120°. Their radial locations with respect to the Z' axis (the axis of rotation of the carrier 20) differ insofar as the radius R for the compression cylinders is different to the radius R for the power cylinders. This is a parameter which can be varied for optimum results according to the particular application. The end positions of the pistons 31 might in conventional technology be referred to as the top dead centre positions. This position is varied in the original design according to the selected length for the respective piston 31. The cross sectional areas of the pistons 31 is selected according to the desired swept volume for a particular operational stroke.

MODIFIED EMBODIMENT OF FIG. 40

Figure 40:
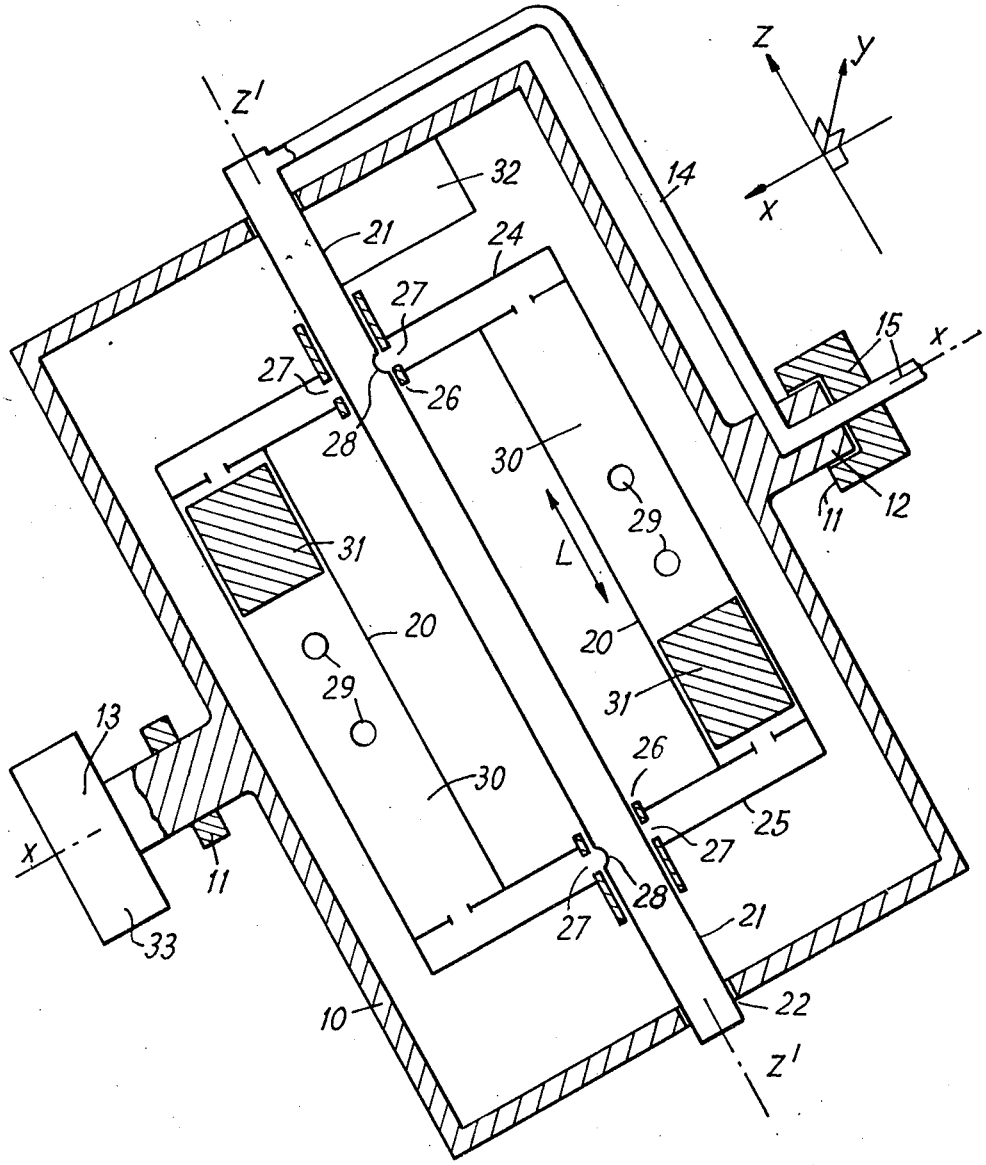

In FIG. 40 there is shown a rotational machine similar to the embodiment of FIG. 1 in which the gearing 41 to 45 has been removed. Instead this embodiment has been provided with an electric motor or generator shown in the block diagram 32 and a prime mover shown at 33. According to whether the machine is operating in the engine mode or the pumping mode then the block diagram 32 schematically represents an electrical generator or an electric motor, the former being driven by the carrier 20, the latter driving carrier 20. At the same time the block diagram 33 represents in the engine mode means for maintaining rotation of the frame 10 and in the pumping mode it likewise represents means for maintaining rotation of the frame 10.

As was described in the description of the embodiment of FIG. 1, the rotational engines useful torque is created on the carrier 20 in the direction about the inner shaft on which the carrier 20 rotates. As a result, power may be taken directly from the inner shaft as long as the outer frame 10 is spinning. Means must be provided to overcome the frictional losses of the machine so as to maintain the spin of the outer frame 10. This is accomplished in the absence of gearing 41 to 45 for example, by the prime mover 33. From the theoretical treatment of the operation of this machine the mathematical expression for the torque produced about the inner shaft reduces to an expression which is proportional to the product of the rotational speeds the carrier 20 and the frame 10. Consequently rotation of the frame 10 is essential to the operation of the machine.

There are several possible ways of conveniently using the power developed by the carrier 20. As indicated above an electric generator 32 may be mounted to be directly driven by the inner shaft of the carrier 20. Consequently, the mechanical power developed by the carrier 20 can be translated into electrical power which can be used to drive an external agency, the provision for this being through conventional means employing for example slip-rings. Alternatively, within the frame 10 of a rotational machine operating in an engine mode according to the aforegoing embodiments, there may be a further rotational machine operating in the pumping mode as previously described. This latter pumping rotational machine may be driven from the carrier of the rotational machine operating in the engine mode.

From the aforegoing it will be readily apparent that modifications may be made within the scope of the appended claims. Advantages and features of the rotational machine according to the aforegoing embodiments include the following. In the internal combustion embodiments the volume ratio of the compression cylinders to the power cylinders may be regarded as a multiplier factor to the compression ratio of the machine.

So far as concerns the fuel admission, the internal combustion embodiment may operate either with a fuel mixture admission or a fuel injection with ignition achieved by conventional sparking plugs. Alternatively it may be operated as a direct diesal injection system.

The valves illustrated in the preferred embodiment are shown as cam valves. With the inertial forces which act and naturally affect all parts of the rotational machine described above, suitable positioning of valves may enable these to be actuated according to inertial forces which enables rapid operation of the valves to be achieved without high stresses being applied.

In the engineering of the system the input and output of fluid medium being pumped or the fuel input and exhaust gas output for the combustion engine, may be engineered in terms of passages and ports in the frame if the frame 10 is considered as a solid structure. It is then necessary to arrange that the ports in the frame 10 coincide in the operation of the carrier 20 at the required points in the cycle.

In the internal combustion embodiment of FIG. 26, cooling may be achieved by way of air cooling brought in to cool fins around the cylinders in the carrier 20. The spin of the carrier 20 and the frame 10 may be employed to drive the cooling air (or other cooling fluid) around the system.

Spark ignition is readily introduced into the machine by employing segmented slip-rings. Such slip-rings may also be employed to perform the function of the conventional electrical distributor.

Lubrication of the bearings of the rotational machine is easily accomplished and oil may be brought into the rotational machine through the centre of the bearings using conventional oil seals. Lubrication of the valve gear of FIG. 40 and the pistons of each of the illustrated embodiments could similarly be accomplished.

The internal combustion embodiments of the rotational machine are intended to have major advantages over conventional crank engines. It is envisaged that the mechanical complexity of the major stressed parts of the rotational machine of the preferred embodiments is very much less than with a conventional crank engine. It is further envisaged that the rotary nature of the present rotational machine enables power delivery to be developed in a very smooth and comparatively vibration free mode of operation.

What is claimed is:

1. Rotational machine for use in developing motive power from a motive pressure medium comprising a shaft journalled for rotation, a frame rotatably coupled to the shaft for rotation therewith, a carrier rotatable in the frame about an axis transversely of the shaft, at least one chamber in the carrier, a piston arranged in the chamber to reciprocate in a direction transverse to the rotational axis of the frame, means acting for transmission of rotation between the carrier and the frame, and, means enabling the ported supply of motive pressure medium to reciprocate the piston, wherein the relative dispositions of rotational axes of the frame and carrier and the path of the piston are such that reaction forces to inertial forces acting on the piston are translated to rotational forces producing a torque on the shaft, whereby in use operation is in an engine mode in which by means of an externally supplied motive pressure medium the piston reciprocates and thereby drives the shaft.

2. Rotational machine as defined in claim 1, wherein said transmission means comprises coupling means for the transmission of rotation from the carrier to the frame.

3. Rotational machine for use in pumping fluid medium comprising a frame arranged to be rotatable about its rotational axis, a carrier rotatable in the frame about an axis transversely of the shaft and adapted to be driven by an external agency, at least one chamber in the carrier, a piston arranged in the chamber to reciprocate in a direction transverse to the rotational axis of the frame, means for rotating the frame, and, porting means in said chamber a port in the carrier communicating with said chamber, an axial inlet in the frame communicating via said porting means with said chamber, wherein the relative dispositions of rotational axes of the frame and carrier and the path of the piston are such that rotational forces producing a torque on the shaft are translated into inertial forces acting on the piston which through reaction forces cause a pumping action in the carrier by reciprocation of the piston to displace fluid medium between said axial inlet of the frame and said port in the carrier communicating with said piston, whereby in use operation is in a pumping mode in which rotation of the carrier by an external agency effects pumping by means of reciprocation of the piston.

4. Rotational machine as defined in claim 3, comprising auxiliary prime mover means arranged to rotate directly the carrier about its own axis.

5. Rotational machine as defined in claim 4, wherein said prime mover means is an electric motor.

6. Rotational machine as defined in claim 3, wherein said means for rotating the frame comprise transmission means for the transmission of rotation from the carrier to the frame.

7. Rotational machine as defined in claim 6, comprising shaft means with which said frame is rotatable, said shaft means being adapted to be driven by an external agency thereby to drive said carrier via said transmission means.

8. Rotational combustion engine comprising
a rotatable frame means,
a carrier means rotatably carried in the frame means,
a plurality of chambers in the carrier means, the carrier means and the frame means having their respective axes of rotation arranged mutually transverse one to the other,
means for transmission of rotation between the carrier means and a driven part,
a piston within each chamber reciprocable transversely to the axis of rotation of the frame means,
means for the admission of fuel into the chambers,
means for ignition of the fuel for combustion thereof to effect reciprocation of the pistons,
and means for exhausting the spent fuel products,
wherein pre-compression of the fuel is effected by the pistons and the sequencing of the piston reciprocations determines that piston motion is translated into rotation of the carrier means for development of motive power for supply to an external mechanism.

9. Rotational combustion engine as defined in claim 8, wherein said driven part is the frame means and said transmission means comprises coupling means between said carrier means and said frame means.

10. Rotational combustion engine as defined in claim 9, wherein said driven part is mechanically connected to be driven by said carrier means and is adapted to drive an external mechanism, means being provided for independently rotating the frame means.

11. Rotational combustion engine as defined in claim 9, wherein said driven part is an electrical generator mounted within said frame means, and by means of which the motive power developed by said carrier means may be converted into electrical power, means being provided to enable said electrical power to be conducted externally of the frame means.

12. Rotational combustion engine as defined in claim 9, wherein said driven part is housed within said frame means and comprises the driven member of a frame of a rotational machine for use in pumping fluid medium, and means is provided for independently rotating the frame means.

* * * * *